US009745031B2

(12) United States Patent
Buechler et al.

(10) Patent No.: US 9,745,031 B2
(45) Date of Patent: Aug. 29, 2017

(54) FIN STABILIZER AND WATERCRAFT

(71) Applicants: Dirk Buechler, Güstrow (DE); Thomas Elsken, Rostock (DE); Sebastian Geier, Schildow (DE); Bram van de Kamp, Brainschweig (DE); Markus Kintscher, Braunschweig (DE); Steffen Opitz, Braunschweig (DE); Martin Pohl, Braunschweig (DE); Andreas Bubbers, Hamburg (DE); Kai Danneberg, Hamburg (DE); Lothar Knippschild, Essen (DE); Thomas Siebrecht, Elmshorn (DE); Holger Spardel, Hamburg (DE); Christian Thieme, Niklitz (DE); Michael Zollenkopf, Hamburg (DE)

(72) Inventors: Dirk Buechler, Güstrow (DE); Thomas Elsken, Rostock (DE); Sebastian Geier, Schildow (DE); Bram van de Kamp, Brainschweig (DE); Markus Kintscher, Braunschweig (DE); Steffen Opitz, Braunschweig (DE); Martin Pohl, Braunschweig (DE); Andreas Bubbers, Hamburg (DE); Kai Danneberg, Hamburg (DE); Lothar Knippschild, Essen (DE); Thomas Siebrecht, Elmshorn (DE); Holger Spardel, Hamburg (DE); Christian Thieme, Niklitz (DE); Michael Zollenkopf, Hamburg (DE)

(73) Assignees: SKF Blohm + Voss Industries GmbH, Hamburg (DE); Deutsches Zentrum für Luft- und Raumfahrt e. V. (DLR), Köln (DE)

( * ) Notice: Subject to any disclaimer, the term of this patent is extended or adjusted under 35 U.S.C. 154(b) by 0 days.

(21) Appl. No.: 14/837,095

(22) Filed: Aug. 27, 2015

(65) Prior Publication Data

US 2016/0059941 A1 Mar. 3, 2016

(30) Foreign Application Priority Data

Aug. 28, 2014 (DE) ..... 10 2014 217 227

(51) Int. Cl.
*B63B 1/28* (2006.01)
*B63B 39/06* (2006.01)
*B63H 1/36* (2006.01)

(52) U.S. Cl.
CPC ..... *B63B 39/061* (2013.01); *B63B 1/28* (2013.01); *B63B 39/06* (2013.01); *B63H 1/36* (2013.01)

(58) Field of Classification Search
CPC .. B63B 1/00; B63B 1/28; B63B 1/283; B63B 2001/28; B63B 2001/281; B63B 39/00;
(Continued)

(56) References Cited

U.S. PATENT DOCUMENTS 2,151,836 A 3/1939 Bugatti
2,979,010 A * 4/1961 Braddon ..... B63B 39/06 114/126

(Continued)

FOREIGN PATENT DOCUMENTS

AT 503039 A4 7/2007
DE 3939435 A1 6/1991

(Continued)

*Primary Examiner* — Daniel V Venne
(74) *Attorney, Agent, or Firm* — Bryan Peckjian; SKF USA Inc. Patent Dept.

(57) ABSTRACT

A fin stabilizer for stabilizing a watercraft against rolling movements includes a main fin configured to be pivoted by a watercraft-side fin drive, a tail fin, and an elastically deformable connection between the main fin and the tail fin, the elastically deformable connection being configured to (Continued)

flex whenever a water force acting on the tail fin is greater than a predetermined amount.

14 Claims, 6 Drawing Sheets

(58) Field of Classification Search
CPC ... B63B 39/06; B63B 39/061; B63B 2001/00; B63B 2039/00; B63B 2039/06; B63B 2039/063; B63B 2039/067; B63B 2039/068
USPC ..... 114/271, 275, 278, 280, 281, 284, 122, 114/126, 127, 128, 132, 144 R, 152, 162
See application file for complete search history.

(56) References Cited

U.S. PATENT DOCUMENTS 2,991,748 A * 7/1961 Muirhead ..... B63B 39/06 114/126
2,996,034 A 8/1961 Jonsson
3,585,956 A * 6/1971 Gwynn ..... B63B 39/06 114/126
3,874,320 A 4/1975 Wood
3,924,555 A * 12/1975 Napolitano ..... B63B 39/06 114/126
4,172,427 A 10/1979 Kindred
4,548,149 A * 10/1985 Del Roso ..... B63H 25/38 114/162
4,777,899 A * 10/1988 Bettcher, Jr. ..... B63B 39/06 114/122
4,928,613 A * 5/1990 Rudolf ..... B63B 41/00 114/128
5,367,970 A 11/1994 Beauchamp et al.
7,210,422 B1 * 5/2007 Hickok ..... B63B 3/44 114/126
2002/0096249 A1 * 7/2002 Meatto ..... B29C 35/0272 156/245
2011/0061579 A1 * 3/2011 Van Gelder ..... B62D 35/007 114/140

FOREIGN PATENT DOCUMENTS

DE 602005004944 T2 3/2009
DE 102011005313 B3 5/2012
FR 2998257 A1 5/2014
SU 529104 A1 9/1976
WO 2014/118749 A1 4/2014

* cited by examiner

FIN STABILIZER AND WATERCRAFT

CROSS-REFERENCE

This application claims priority to German patent application no. 10 2014 217 227.6 filed on Aug. 28, 2014, the contents of which are fully incorporated herein by reference.

TECHNICAL FIELD

The present disclosure is directed to a fin stabilizer for stabilizing a watercraft and to a watercraft including a fin stabilizer.

BACKGROUND

Stabilizers for watercraft, in particular fin stabilizers, may be used both for stabilizing watercraft while underway (while operating or traveling) as well as for stabilizing watercraft that are anchored or moving at low speed during "pre-anchor" operation. The requirements for stabilizing a watercraft moving at a relatively high speed, however, are different than (and conflict with) the requirements for stabilizing a watercraft moving slowly or not at all. Stabilizer fins optimized for driving/traveling operation preferably have a wide span and a short chord length relative thereto. Lifting forces for stabilizing the watercraft are produced by the oncoming/incident flow of water during travel and the angle of attack of the fin stabilizers. To minimize the required drive torque, (the torque required to maintain or change the angle of attack) the axis of rotation should be located in the vicinity of the center of lift of the fin stabilizer.

For pre-anchor stabilizing, on the other hand, there is no or negligible oncoming flow with respect to the stabilizer fins. Therefore, forces for counteracting a rolling movement must be generated by the fin stabilizers themselves, that is by moving the stabilizer fins to displace water and/or create a flow of water around the moved stabilizer fin. For a fin having approximately the same span width, stabilizer fins used for pre-anchor stabilizing should have a large chord length and an axis of rotation closer to the nose of the stabilizer fin. High drive torques are required in order to allow stabilizers adapted for pre-anchor operation to also be used to effectively counteract rolling movements of the watercraft in driving operation. Due to the large stabilizer fin and the requirement for a powerful drive, these stabilizer systems are heavy, consume a relatively large amount of power and occupy a large space in the watercraft. Furthermore, when designing fin stabilizers, a compromise must be made between optimizing the stabilizer for driving operation and optimizing the stabilizer for pre-anchor operation.

A fin including a variably adjustable outer contour is disclosed in U.S. Pat. No. 5,367,970 A. Control wires are integrated in the fin which change the curvature of the fin when their lengths change. The change in length is regulated by a control system.

A fin stabilizer for stabilizing a watercraft is known from DE 102011005313 B3. This stabilizer includes a main fin that is pivotable by a watercraft-side fin drive and a tail fin that is movably supported on the main fin. The fin stabilizer includes a locking device that actively regulates the pivoting of the tail fin. In pre-anchor operation the locking device blocks a possible pivoting movement of the tail fin and thereby increases the surface of the stabilizer fin. In driving operation the locking device is switched to free movement (unlocked) and makes possible a free pivoting movement of the tail fin so that the surface of the stabilizer fin is reduced.

These known concepts provide for a more effective stabilizing of watercraft than one-part stabilizer fins, in particular by adjusting the effective surface area of the stabilizer fins. However, in both cases an active regulating device is required to select between pre-anchor and driving operation states. Furthermore in DE 102011005313 the locking device includes of a variety of mechanical or hydraulic components.

U.S. Pat. No. 2,151,836 A discloses a boat including collecting surfaces for wave shocks as well as support surfaces that reduce the tendency of the bow to sink. Publication DE 60 2005 004 944 T2 discloses an active roll-stabilization system for ships. Stabilizing fins for damping the longitudinal movement of keel yachts are known from publication DE 39 39 435 A1.

SUMMARY

One aspect of the present disclosure is to provide an improved fin stabilizer for a watercraft that effectively stabilizes a watercraft both in driving operation and in pre-anchor operation. Another aspect of the disclosure is to provide a watercraft that is highly stabilized against rolling movement both during pre-anchor operation and during driving operation.

A disclosed fin stabilizer for stabilizing a watercraft includes a main fin that is pivotable by a watercraft-side fin drive and a tail fin. The tail fin is elastically deformable if excessive water forces act thereon, that is, if water forces against the tail fin exceed a predetermined level. The water forces thereby automatically set a tail fin angle. Alternatively or additionally a connection body for automatically setting a tail fin angle can be disposed between the tail fin and the main fin, which connection body sets the tail fin angle based on a force of the water acting on the tail fin. Stated another way, the connection body varies the tail fin angle based on the force of water acting on the tail fin.

Both the flexible tail fin and the connection body for automatically setting a tail fin angle are passive, and thus control devices, active control systems and the like are not necessary. Active control devices do not need to be integrated in the fin stabilizer, which makes the fin stabilizer lighter and less complex than conventional fin stabilizers of the same size. Manufacturing and maintenance expenses are also significantly reduced. The flexible tail fin and/or connection body acts like a spring having a spring constant that is adapted to the forces that are expected to act on the stabilizer fin. In pre-anchor operation the effective surface area of the stabilizer fin is extended by the tail fin. This is because, in pre-anchor operation, the force acting on the tail fin when the fin drive operates produces little or no deflection of the tail fin. However, during driving operation a flow of water acts in addition to the fin drive, and the force of this water acting on the tail fin deflects the tail fin. The effective surface area of the stabilizer fin is thus reduced during driving operation. The drive torque of the stabilizer fin drops and thus a greater angle of attack and greater lifting force resulting therefrom for reducing rolling is achieved.

In one exemplary embodiment the tail fin is pivotably supported on the main fin for movement about a pivot axis. A defined mechanical pivoting of the tail fin is thus made possible. The connection body can thereby be an assembly of at least one elastic deformation body, a cylinder-piston assembly, a dual-action torsion spring seated on the pivot axis and the like, which passively adjust the tail fin angle and the pivoting of the tail fin.

According to a preferred exemplary embodiment of the fin stabilizer, the connection body includes a deformation body that at least partially connects the main fin to the tail fin. The deformation body is preferably comprised of a one-part elastic plastic, or an elastic combination of plastics and other suitable materials, and has a defined spring constant. The mechanical pivot axis between the tail fin and the main fin can thereby be completely replaced by the connection body.

In a further preferred exemplary embodiment of the fin stabilizer the deformation body is multi-part, for example, multi-layer. The individual bodies or layers can have different thicknesses, and the orientation of the layers can be selected based on the required properties of the deformation body. Reinforcing fibers can be embedded in the deformation body. The behavior of the tail fin can be precisely set by the composition of the deformation body and by the geometric shaping and the thickness or thickness distribution of the layers of the deformation body.

According to an advantageous exemplary embodiment the connection body includes at least one stabilizing element. This stabilizing element preferably limits the degrees of freedom for movement of the tail fin to those that are necessary for the operation of the fin stabilizer. In other words, the tail fin is only allowed to flex or pivot in a manner that improves stabilization, and movements that do not improve stabilization are reduced or substantially prevented. The stabilizing element thus acts like a pivot guide that prevents a twisting of the connection body. This stabilizer element is preferably incorporated in the center or in the neutral phase of the deformation body. The layer element can comprise, for example and without limitation, a plastic, a fiber composite material, a metal, or a metal hybrid material or the like.

In an advantageous embodiment of the fin stabilizer the stabilizing element at least sectionally connects the tail fin to the main fin. This ensures at least one continuous connection between the main fin and the tail fin, and the tail fin will still be reliably connected to the main fin even if the deformation body is damaged.

The securing element of the fin stabilizer preferably includes at least one web at least on one side thereof. This provides a planar rib-type bracing of the deformation body. Preferably a plurality of webs, in particular wall-type webs, are provided, and at least some intermediate spaces between the webs are filled with compressible and stretchable materials such as plastic foams. Furthermore, multi-part, in particular multi-layer deformation combinations and the like can be used in the intermediate spaces. This helps make possible a defined transmission to the deformation body of the forces acting on the tail fin. The spring constant of the deformation body can be precisely set via the materials in the intermediate spaces. However, the materials can also be chosen such that their influence on the spring constant is negligible compared to the influence of a central plane of the deformation body. For example, it may be desirable to choose the materials used in the intermediate spaces so that, depending on the pivot angle, differently-sized resistances must be overcome. Likewise the materials in the intermediate spaces can be chosen such that, depending on the pivot angle, an increasing resistance for pivoting the tail fin must be overcome. That is, the forces that must be overcome to pivot the tail fin may increase with increasing pivot angle.

In a further advantageous exemplary embodiment of the fin stabilizer, the connection body or the tail fin includes, at least in sections, a friction-fit and/or interference-fit connection to the main fin. The connection body also preferably transitions flush into the tail fin. This allows such a fin stabilizer to be manufactured with a high degree of automation utilizing common manufacturing processes. Screw connections and dovetail joints are examples. Alternatively or additionally the connection body can also be connected in a materially bonded manner, for example, adhered, to the main fin and/or the tail fin.

The connection body or the tail fin can extend flush or smoothly or in a stepwise manner from the main fin. In particular, a flow-optimizable shape of the fin stabilizer results from the flush design. Eddies in the transition regions between the main fin and the connection body and between the connection body and the tail fin can thus effectively be prevented. The manufacturing of the fin stabilizer can be simplified by the stepwise design.

A watercraft equipped with the disclosed fin stabilizer is characterized, in particular with a simplified fin stabilizer and by high roll stabilization, both in driving operation and in pre-anchor operation.

BRIEF DESCRIPTION OF THE DRAWINGS

Preferred exemplary embodiments of the disclosure are explained in more detail with reference to the following greatly simplified schematic illustrations.

DETAILED DESCRIPTION

Figure 1:
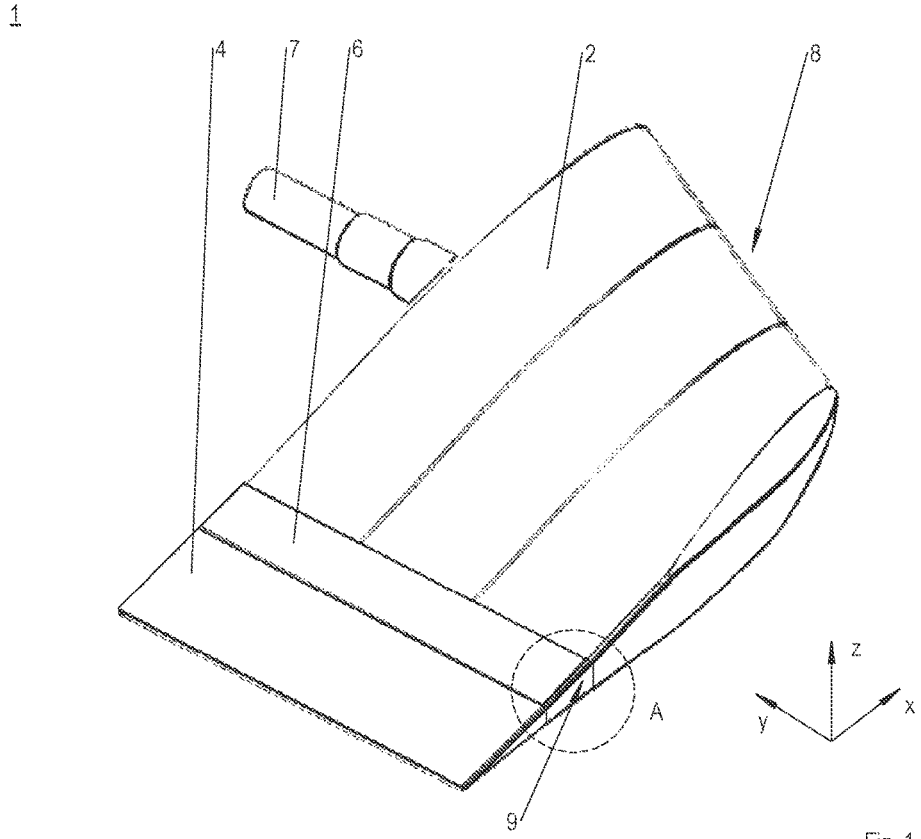
FIG. 1 is a perspective view of a first exemplary embodiment of a fin stabilizer according to an embodiment of the present disclosure in the uninstalled state.

In the drawings, identical structural elements are identified by identical reference numerals. For clarity, in some Figures only some of the same structural elements are provided with a reference numeral.

FIG. 1 shows a perspective view of a first exemplary embodiment of a fin stabilizer 1 according to the disclosure. The fin stabilizer 1 includes a main fin 2 (referred to as the first fin in the claims) and a tail fin 4 (referred to as the second fin in the claims) that are connected via a connection body 6. The connection body 6 allows for automatically setting a tail fin angle $\alpha$ with respect to the main fin 2. The connection body 6 is disposed in the longitudinal direction x of the fin stabilizer 1 between the main fin 2 and the tail fin 4. The tail fin angle $\alpha$ is explained in more detail with reference to FIG. 2.

Figure 10:
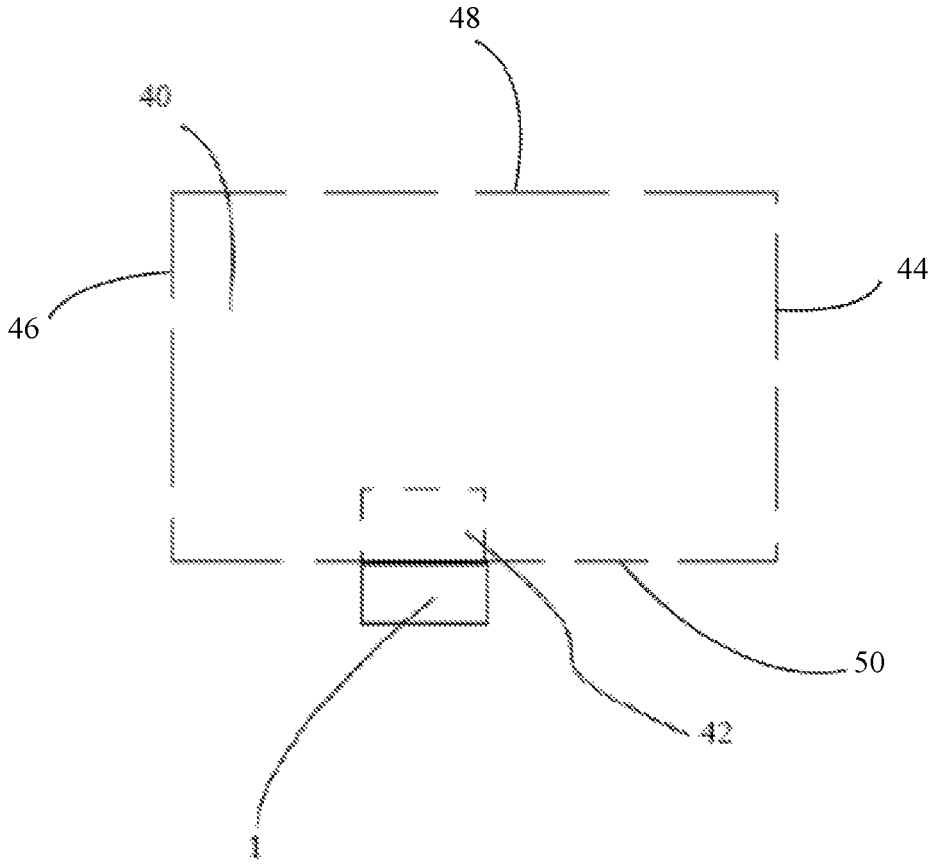
FIG. 10 is a schematic of the watercraft with a fin stabilizer thereon.

The main fin 2 is driven via a drive shaft 7 by a conventional watercraft-side fin drive 42 of a conventional watercraft 40 (illustrated in schematically in FIG. 10 wherein the watercraft 40 and fin drive 42 are illustrated in dashed lines to illustrate that no specific shape or size of the watercraft 40 or fin drive 42 is being disclosed and no specific location of the fin drive 42 or fin stabilizer 1 on the watercraft 40 is being disclosed). The watercraft 40 includes a bow 44, stern 46, port side 48, and starboard side 50, wherein the watercraft-side fin drive 42 may be located on the starboard side 50. The drive shaft 7 extends in or nearly in the transverse direction y of the fin stabilizer 1 and is centrally disposed in the height direction z of the fin stabilizer 1. An opening (not illustrated) for producing an effective connection between the drive shaft 7 and the fin stabilizer 1 is disposed close to a leading edge 8 (viewed from the oncoming flow) of the main fin 2 and distant from a trailing edge 9 of the main fin 2, and thus relatively distant from the tail fin 4.

Figure 2:
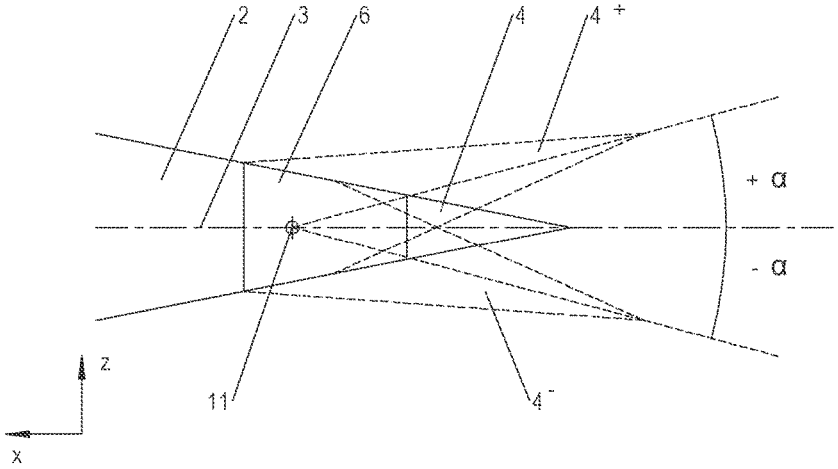
FIG. 2 is a simplified, partial, sectional view through the X-Z plane of FIG. 1.

FIG. 2 illustrates how the tail fin 4 is deflectable relative to a main-fin central plane 3 through a tail fin angle $\alpha$ using a simplified sectional view of the first exemplary embodiment. A position of the tail fin 4 deflected by the tail fin angle $+\alpha$ is identified by reference number 4+. A position of the tail fin 4 deflected by the tail fin angle $-\alpha$ is identified by the reference number 4–. The respective position results from the forces acting on the tail fin 4. The orientation of the tail fin 4 is always affected by the direction of a water flow acting on the main fin 2. A pivot axis 11 indicated by the reference number 11 serves merely as a reference point for defining the tail fin angle. The tail fin referenced by number 4+ and 4– is enlarged merely for clarity, in operation the shape and length of the tail fin remains unchanged (only the angle of the tail fin 4 with respect to the main fin 2 varies).

Figure 3:
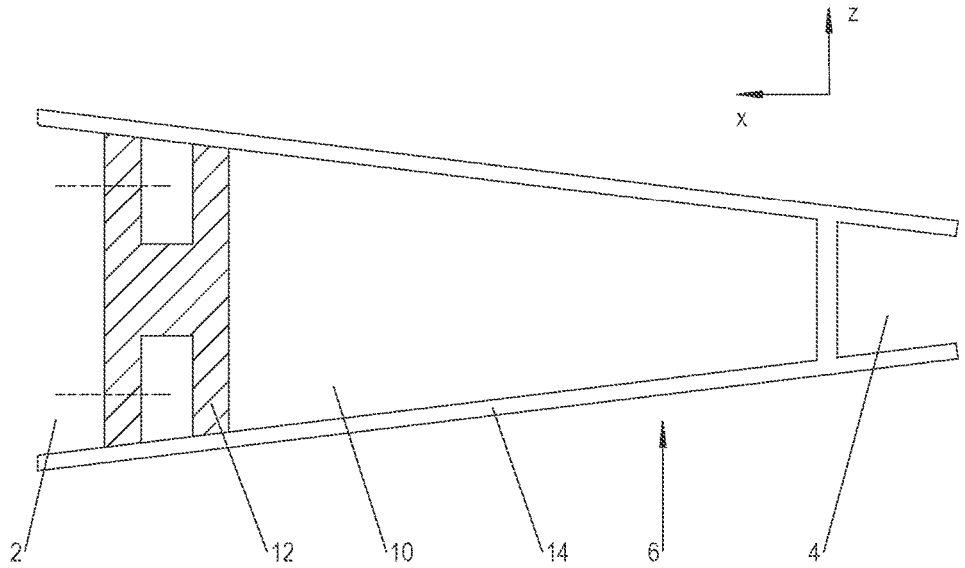
FIG. 3 is a sectional view of Region A in FIG. 1 in the X-Z plane.

FIG. 3 shows a section of the connection body 6 in region A from FIG. 1 along the oncoming-flow direction of the fin stabilizer 1. In this exemplary embodiment the connection body 6 is configured as a one-part, elastic deformation body 10. The deformation body 10 extends over the respective entire extension of the stabilizer fin 1 in the trailing edge region of the main fin 2 in transverse direction y and in height direction z. For example, the deformation body 10 is comprised of polyurethane. The connection body 6 serves as a kind of pivot axis 11 (FIG. 2) and as a connection between the main fin 2 and the tail fin 4. The tail fin 4 is pivotally secured to the main fin 2 by the connection body 6 such that the tail fin 4 is spaced from the main fin 2 and does not directly contact any portion of the main fin 2. In addition to the deformation body 10, the connection body 6 includes a main-fin-side connecting element 12 that connects the deformation body 10 to the main fin 2. In this embodiment, the connecting element 12 has an H-shaped cross-section and is preferably flexurally stable and screwed to the main fin. A tail-fin-side connecting element is not depicted, but can be constructed in an analogous manner. The connection between the deformation body 10 and the tail-fin-side connecting element can be effected, for example, by material bond.

The main-fin-side connecting element 12, the deformation body 10 of the connection body 6, and the tail-fin-side connecting element (not illustrated) are configured to maintain a streamlined shape between the main fin 2 and the tail fin 4. An outer skin 14 covering the deformation body 10, the main-fin-side connecting element 12, and the tail-fin-side connecting element transitions flush or in a stepless manner from the main fin 2 to the tail fin 4.

Figure 4:
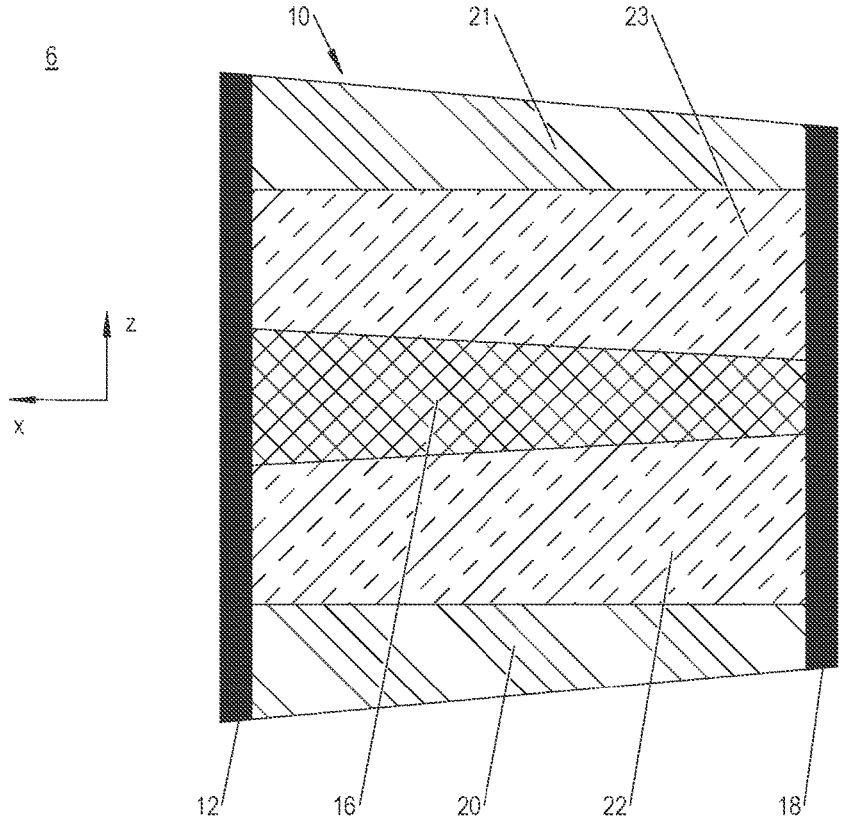
FIG. 4 is a sectional view through a partial region of a fin stabilizer according to a second exemplary embodiment of the disclosure.

A section through a second exemplary embodiment of the fin stabilizer 1, taken in the region of a connection body 6 for automatically setting a tail fin angle $\alpha$ between the tail fin 4 and the main fin 2, is shown in FIG. 4. The connection body 6 includes multiple elements, and in particular has a multi-layer deformation body 10 that extends over the entire transverse extension and height extension of the fin stabilizer 1 in the trailing edge region of the main fin 2. It is connected to a main-fin-side connecting element 12 and to a tail-fin-side connecting element 18. It has a stabilizing element 16 (referred to as a rigid element in the claims) that is incorporated in the neutral phase of the deformation body 10 and extends between the main-fin-side connecting element 12 and the tail-fin-side connecting element 18. The stabilizing element 16 helps prevent the connection body from twisting when it elastically deforms. Two layers 21, 23 and 20, 22 are respectively disposed on both sides of the stabilizing element 16.

Depending on the requirements for the multi-layer deformation body 10, the thickness, i.e. the extension in height direction z, of the stabilizing element 16 and of the individual layers 20, 21, 22, and 23 can vary. Likewise, the individual layers 20 to 23 can be comprised of different materials. The stabilizing element may be a rigid material, for example, a plastic-based fiberglass composite material; the two inner layers 22, 23 abutting directly on the stabilizing element 16 may be comprised, for example, of a polyurethane foam or polyethylene foam, and the two outer layers 20, 21 may be comprised, for example, of a non-foam polyurethane elastomer.

The stretchable and compressible layers 20, 21, 22, 23 are adapted to the stabilizing element 16 in terms of their thickness. The desired shape of the connection body 6 thus results, and thus also the shape of the transition from the main fin 2 to the tail fin 4. In the second exemplary embodiment the stabilizing element 16 tapers towards the tail fin. The inner layers 22, 23 increase in height in the tail fin direction, whereas the outer layers 20, 21 are tapered towards the tail fin to set the flow-optimized shape. Of course, other patterns are also possible.

Figure 5:
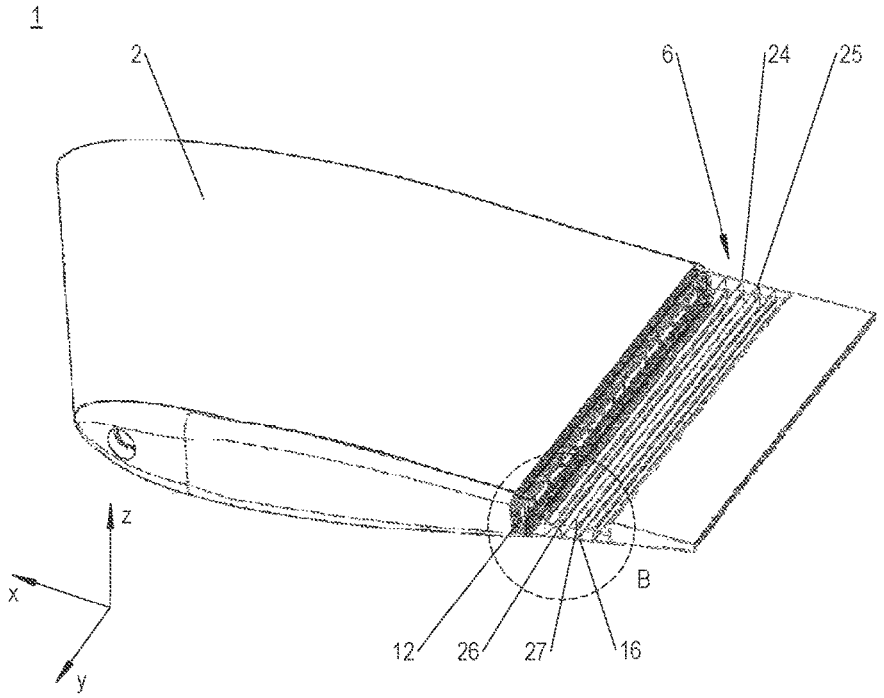
FIG. 5 is a perspective illustration of a fin stabilizer according to a third exemplary embodiment.

FIG. 5 shows a perspective view of a third exemplary embodiment of the fin stabilizer 1 including a connection body 6 for automatically setting a tail fin angle $\alpha$ between a tail fin 4 and a main fin 2. The connection body 6 includes a multi-part deformation body 10 in which a stabilizing element 16 is embedded, which is incorporated in the neutral phase. Here the stabilizing element is plate-shaped and has webs 24, 25, 26, 27 disposed on both sides thereof. The webs 24, 25, 26, 27 are disposed opposite one another and extend in the height direction z of the fin stabilizer 1 along the entire extension of the fin stabilizer 1 in transverse direction y in the region of the deformation body 10. A detailed explanation of the webs is provided below with reference to FIG. 6.

Figure 6:
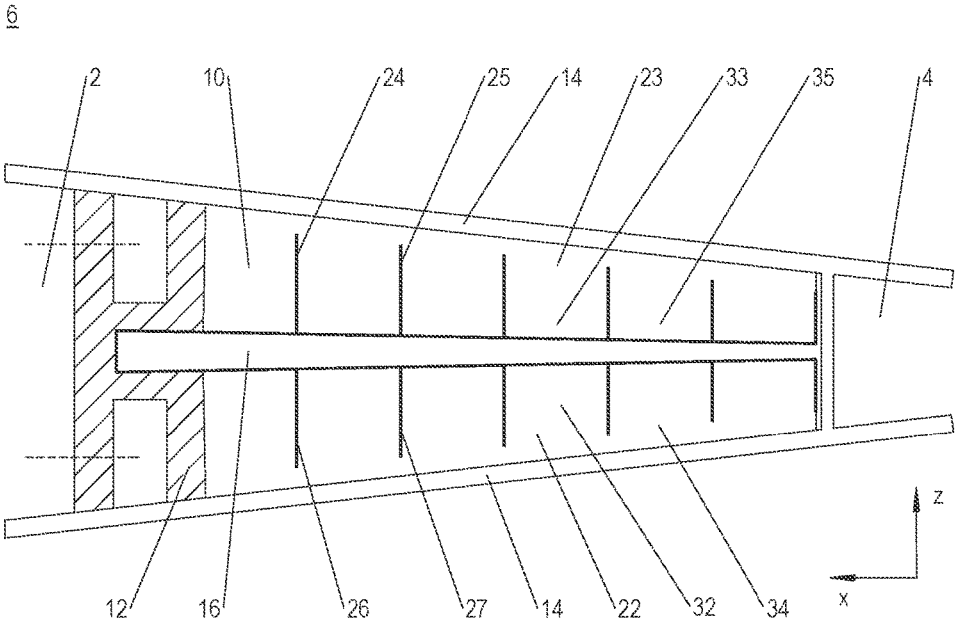
FIG. 6 is a sectional view through Region B in FIG. 5 in the X-Z plane.

An enlarged section of the region B from FIG. 5 is depicted in FIG. 6. The connection body 6 is connected to the main fin 2 via an H-shaped connecting element 12. The connecting element 12 is identical to the connecting element shown in the first exemplary embodiment and is not further described. The connection of the tail fin 4 to the connection body 10 is also identical to that of the first exemplary embodiment, so repeated explanations are omitted, and reference is made to the explanations for FIG. 2.

The webs 24, 25, 26, 27 are wall-shaped and extend orthogonally from the stabilizing element 18 in the height direction z. They are each preferably uniformly spaced from one another in the longitudinal direction x of the fin stabilizer 1, and their heads or distal ends are spaced from the outer skin 14. Due to the flow-optimized shape of the deformation body 10, the webs or walls 24, 25, 26, 27 extend away from the stabilizing element 16 to different extents;

that is, they have different lengths or heights. Due to the mutual spacing, a plurality of intermediate spaces 32, 33, 34, 35 are formed that connect to each other at the head side (distal ends) of the webs 28, 29, 30, 31. In this exemplary embodiment the intermediate spaces 32, 33, 34, 35 are filled with a plastic foam 22, 23. The stabilizing element 16 and the webs 28, 29, 30, 31 are also preferably comprised of plastic. For mutual dovetailing/meshing/engagement of the plastic material in the intermediate spaces 32, 33, 34, 35, the webs can also be provided with corresponding holes for receiving or permeation of the plastic material. Piercing be provided with the plastic material. During a deforming of the connection body 10 the webs 28, 29, 30, 31 of one side are moved towards each other at the head side, and the plastic material in the respective intermediate spaces 32, 33, 34, 35 is pressed together. This affects a pivoting behavior of the tail fin and allows this behavior to be adjusted.

Figure 7:
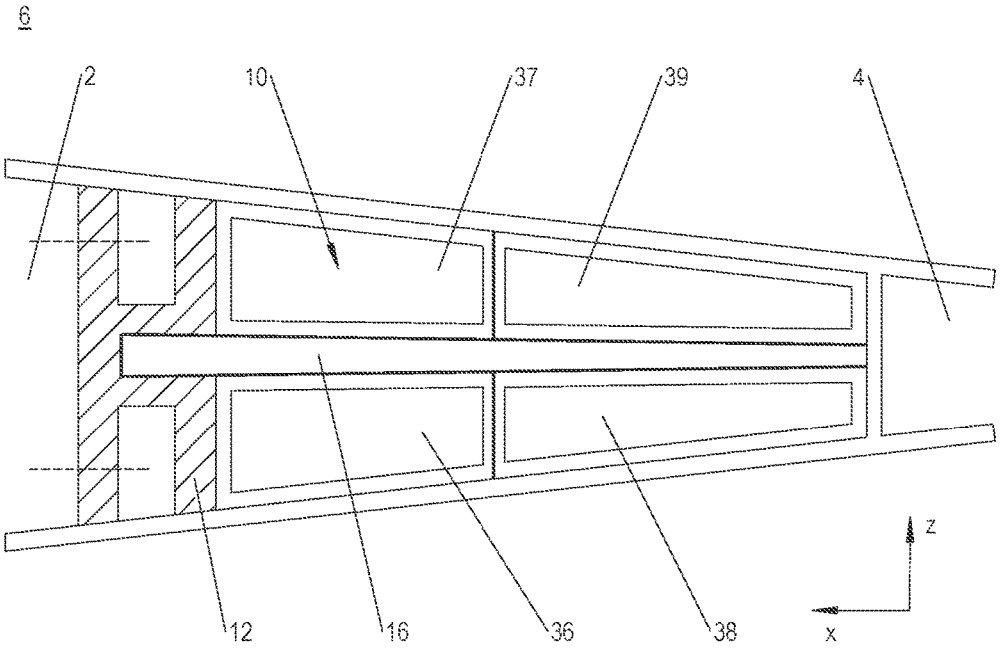
FIG. 7 is a sectional view through a partial region of a fourth exemplary embodiment.

A section through a connection body 6 for automatically setting a tail fin angle α between a tail fin 4 and a main fin 2 of a fourth exemplary embodiment of a fin stabilizer 1 is shown in FIG. 7. The essential difference from the third exemplary embodiment is that this embodiment includes a multi-part deformation body 10, and a plate-shaped stabilizing element 16 separates parts of the deformation body 10, and the deformation body includes self-contained chambers 36, 37, 38, 39. There is no mutual connection of the chambers or intermediate spaces 36, 37, 38, 39 as there is in the third exemplary embodiment shown in FIG. 6. The chambers 36, 37, 38, 39 are disposed in pairs one-behind-the-other on both sides of the stabilizing element 16 and filled, for example, with a plastic foam.

Figure 8:
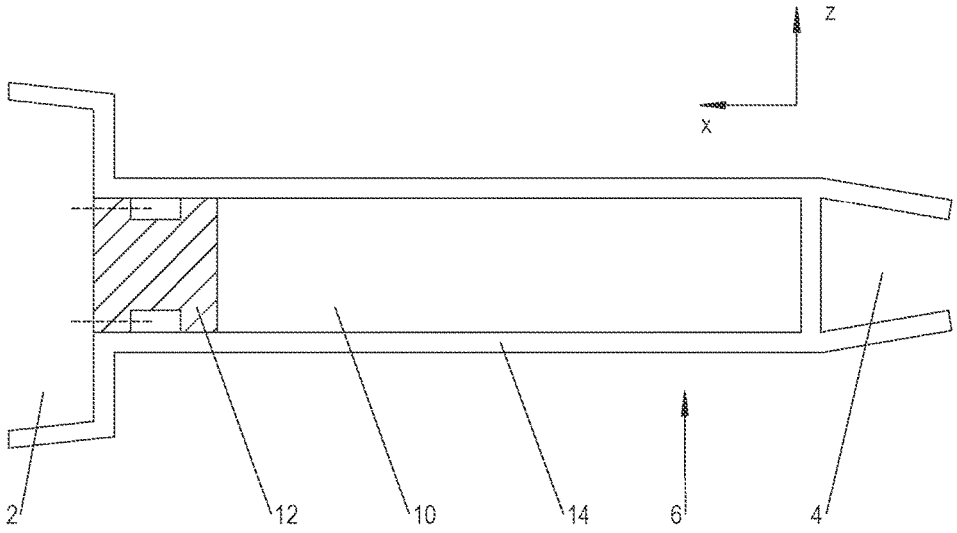
FIG. 8 is a sectional view through a partial region of a fifth exemplary embodiment.

FIG. 8 shows a section through a connection body 6 for automatically setting a tail fin angle α between a tail fin 4 and a main fin 2 of a fifth exemplary embodiment of a fin stabilizer 1. The essential difference from the already-shown exemplary embodiments is the stepped shape of the connection body 6 or of its deformation body 10 in the region of the main-fin-side connecting element 12 and thus in the transition region from the main fin 2 to the connection body 6. For example, the deformation body 10 may have a rectangular longitudinal section. Thus the outer skin 14 extends towards the tail fin 4 parallel to the main-fin central plane 3. As in the preceding exemplary embodiments the tail fin 4 is preferably streamlined, and in this embodiment, it extends flush from the connection body 6. The tail fin 4 can also optionally be omitted. The connection body 6 or its deformation body 10 thus fulfills the function of the tail fin 4, since in driving operation the connection body 6 yields to water forces acting thereon and remains almost rigid in pre-anchor operation. For this purpose see also the exemplary embodiment described in FIG. 9, wherein the connection body 6 or the deformation body 10 forms the tail fin 4, or the tail fin 4 is the connection body 6 or the deformation body 10.

Figure 9:
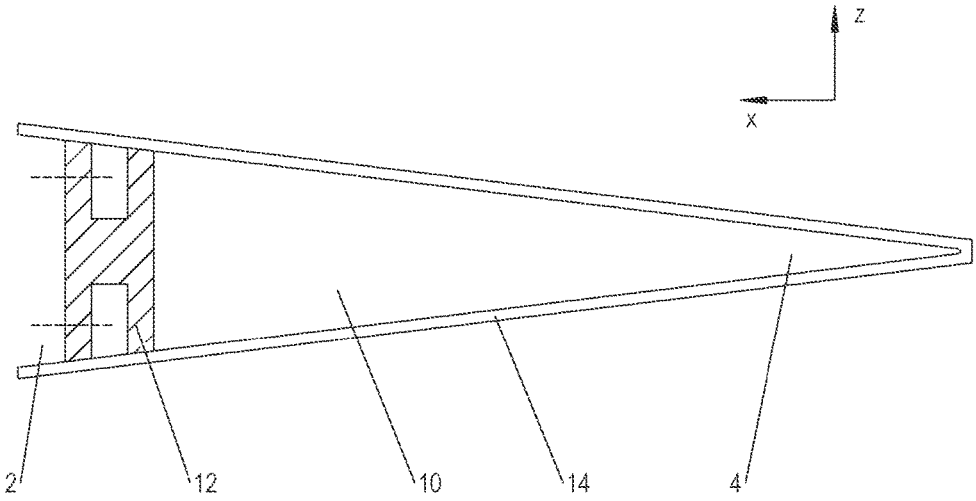
FIG. 9 is a sectional view through a partial region of a sixth exemplary embodiment.

A section through a region of a sixth exemplary embodiment of the fin stabilizer is depicted in FIG. 9. For automatically setting a tail fin angle α, in this exemplary embodiment the tail fin 4 is embodied so that it is elastically deformed when excessive water force, that is, water force greater than a predetermined level, acts thereon. The connection body 6 or the deformation body 10 is virtually integrated in the tail fin 4 and does not represent an individual component. The tail fin 4 is thus directly connected to the main fin 2. All features of the connection body 6, such as intermediate spaces and webs, can be integrated into the elastic tail fin 4.

The operation of the connection body 6 for the automatically setting a tail fin angle α will now be explained. This description relates to all fin stabilizers shown in FIGS. 1 to 7. The connection body 6, and in particular its one-part or multi-part deformation body 10, acts like a spring the spring constant of which is set such that during pre-anchor operation no or nearly no pivoting of the tail fin 4 relative to the main fin 2 occurs, whereas during driving operation the tail fin 2 is oriented by the direction of a water flow. The spring constant is determined by the construction of the deformation body 10 and results from individual material properties of the layers 20, 21, 22, 23, intermediate-space fillers, chamber fillers, stabilizing elements 16, and webs 28, 29, 30, 31 which compose the multi-part deformation bodies shown here as examples. The connection body 6 effectively forms a load acting on the tail fin 4 due to an elastic deforming of a pivot axis 11 indicated in FIG. 2.

In pre-anchor operation the connection body 6 increases the effective surface area of the fin stabilizer 1 by an amount equal to the surface area of the tail fin 4, since the force acting on the tail fin 4 during a pivoting of the fin stabilizer 1 is not sufficient to significantly deflect the tail fin 4 by the tail fin angle +α, −α. In pre-anchor operation an effective surface area of the fin stabilizer 1 is formed by the main fin 2 and by nearly the entire surface of the tail fin 4. Stated another way, if the water force acting on the tail fin 4 is below a predetermined amount, for example when the watercraft is in pre-anchor operation, the connection body 6 having spring-like properties does not deflect the tail fin 4, and hence, generally maintains the tail fin 4 in its equilibrium state. In driving operation, however, the water flow also acts to drive the tail fin 4, so that force acting on the tail fin 4 deflects the tail fin 4 based on the direction of flow. The surface of the fin stabilizer 1 is thus reduced in driving operation so that the fin stabilizer 1 can be strongly deflected by the fin drive. In driving operation the tail fin 4 is thus effectively in free movement or free-floating, so that in driving operation the surface area of the fin stabilizer 1 is formed in largest part by the main fin 2.

A fin stabilizer 1 is disclosed for stabilizing a watercraft 40, which fin stabilizer 1 includes a main fin 2 that is pivotable by a watercraft-side fin drive, and a tail fin 4 that is movably supported on the main fin 2. The stabilizer 1 includes a connection body 6 for automatically setting a tail fin angle between the tail fin 4 and that main fin 2 based on a water force acting on a surface of the tail fin 4, as well as a watercraft that is stabilized by at least one such fin stabilizer 1.

Representative, non-limiting examples of the present invention were described above in detail with reference to the attached drawings. This detailed description is merely intended to teach a person of skill in the art further details for practicing preferred aspects of the present teachings and is not intended to limit the scope of the invention. Furthermore, each of the additional features and teachings disclosed above may be utilized separately or in conjunction with other features and teachings to provide improved fin stabilizer.

Moreover, combinations of features and steps disclosed in the above detailed description may not be necessary to practice the invention in the broadest sense, and are instead taught merely to particularly describe representative examples of the invention. Furthermore, various features of the above-described representative examples, as well as the various independent and dependent claims below, may be combined in ways that are not specifically and explicitly enumerated in order to provide additional useful embodiments of the present teachings.

All features disclosed in the description and/or the claims are intended to be disclosed separately and independently from each other for the purpose of original written disclosure, as well as for the purpose of restricting the claimed subject matter, independent of the compositions of the features in the embodiments and/or the claims. In addition, all value ranges or indications of groups of entities are intended to disclose every possible intermediate value or intermediate entity for the purpose of original written disclosure, as well as for the purpose of restricting the claimed subject matter.

REFERENCE NUMBER LIST

1 Fin stabilizer
2 Main fin
3 Main-fin central plane
4 Tail fin
4+ Tail fin deflected by +α
4– Tail fin deflected by –α
6 Connection body
7 Drive shaft
8 Leading edge of the main fin
9 Trailing edge of the main fin
10 Deformation body
11 Pivot axis
12 Main-fin-side connecting element
14 Outer skin
16 Stabilizing element
18 Tail-fin-side connecting element
20 Layer
21 Layer
22 Layer
23 Layer
24 Web
25 Web
26 Web
27 Web
32 Intermediate space
33 Intermediate space
34 Intermediate space
35 Intermediate space
36 Chamber
37 Chamber
38 Chamber
39 Chamber
α Tail fin angle
x Longitudinal direction
y Transverse direction/width direction
z Height direction/thickness direction

We claim:

1. A fin stabilizer for stabilizing a watercraft against rolling movements, the fin stabilizer comprising:

a first fin connected to and configured to be pivoted by a drive shaft and having a first fin central plane, a second fin being spaced from the first fin such that the second fin does not directly contact any portion of the first fin, and a connection body comprising at least one elastic deformation body formed out of at least a first material and a rigid element formed out of a second material, the connection body being deformable and connecting the second fin to the first fin such that an angle between the second fin and the first fin central plane can vary, the connection body holding the second fin at a first angle with respect to the first fin central plane when a water force acting on the second fin is lower than a predetermined amount, the connection body being configured to change the angle between the second fin and the first fin central plane whenever the water force acting on the second fin is greater than the predetermined amount, the connection body being elastic such that when the water force acting on the second fin decreases from above the predetermined amount to below the predetermined amount the second fin reverts back to the first angle, wherein the connection body is connected to the first fin by a first connecting element and the connection body is connected to the second fin by a second connecting element, the rigid element extends from the first connecting element to the second connecting element and is embedded within the at least one deformation body, and wherein the first material is different than the second material.

2. The fin stabilizer according to claim 1, wherein the second fin is pivotably supported on the first fin about a pivot axis, the pivot axis being located within the connection body.

3. The fin stabilizer according to claim 1, wherein the at least one elastic deformation body at least partially connecting the first fin to the second fin.

4. The fin stabilizer according to claim 3, wherein the at least one elastic deformation body comprises a plurality of layers of different materials.

5. The fin stabilizer according to claim 3, wherein the at least one elastic deformation body is connected to the first fin by a friction-fit and/or interference-fit.

6. The fin stabilizer according to claim 3, wherein the at least one elastic deformation body extends from the first fin along the first fin central plane and connects the first fin to the second fin in a stepless manner.

7. The fin stabilizer according to claim 1, wherein the at least one rigid element at least sectionally connects the second fin to the first fin.

8. The fin stabilizer according to claim 1, wherein the rigid element includes at least one web.

9. A watercraft including at least one fin stabilizer according to claim 1.

10. The fin stabilizer according to claim 1, wherein the second fin is configured to retain its shape during operation such that the second fin does not deform during operation.

11. The fin stabilizer according to claim 1, wherein the first material is formed out of one of a polyurethane foam, a polyethylene foam, and a non-foam polyurethane elastomer, and, the second material is formed out of a plastic-based fiberglass composite material.

12. A fin stabilizer for stabilizing a watercraft against rolling movements, the fin stabilizer comprising:

a first fin connected to and configured to be pivoted by a drive shaft and having a first fin central plane, a second fin being spaced from the first fin such that the second fin does not directly contact any portion of the first fin, and a connection body being deformable and connecting the second fin to the first fin such that an angle between the second fin and the first fin central plane can vary, the connection body holding the second fin at a first angle with respect to the first fin central plane when a water force acting on the second fin is lower than a predetermined amount, the connection body being configured to change the angle between the second fin and the first fin central plane whenever the water force acting on the second fin is greater than the predetermined amount, the connection body being elastic such that when the water force acting on the second fin decreases from above the predetermined amount to below the predetermined amount the second fin reverts back to the first angle, wherein the connection body comprises at least one elastic deformation body between the first fin and the second fin, the at least one elastic deformation body at least partially connecting the first fin to the second fin, wherein the at least one elastic deformation body includes at least one rigid element sectionally connecting the second fin to the first fin and wherein the at least one rigid element includes at least one web.

13. A fin stabilizer for stabilizing a watercraft against rolling movements, the fin stabilizer comprising:

a first fin connected to and configured to be pivoted by a drive shaft and having a first fin central plane, a second fin, and a connection body being deformable and connecting the second fin to the first fin such that an angle between the second fin and the first fin central plane can vary, the connection body holding the second fin at a first angle with respect to the first fin central plane when a water force acting on the second fin is lower than a predetermined amount, the connection body being configured to change the angle between the second fin and the first fin central plane whenever the water force acting on the second fin is greater than the predetermined amount, the connection body being elastic such that when the water force acting on the second fin decreases from above the predetermined amount to below the predetermined amount the second fin reverts back to the first angle, the fin stabilizer further comprising a rigid element in the connection body extending in a direction from the first fin toward the second fin, the rigid element having a plurality of webs extending away from the rigid element.

14. The fin stabilizer according to claim 13, wherein the plurality of webs extend in a perpendicular direction with respect to a longitudinal direction of the fin stabilizer.

* * * * *